US005521462A

United States Patent [19]

Muchi et al.

[11] Patent Number: 5,521,462

[45] Date of Patent: May 28, 1996

[54] ELECTRON GUN FOR CRT

[75] Inventors: Tsuneo Muchi; Shigenori Tagami, both of Kanagawa; Hiroaki Ishiguro; Tsunenari Saito, both of Tokyo, all of Japan

[73] Assignee: Sony Corporation, Tokyo, Japan

[21] Appl. No.: 287,296

[22] Filed: Aug. 8, 1994

[30] Foreign Application Priority Data

Aug. 9, 1993 [JP] Japan ..... 5-216968
Nov. 30, 1993 [JP] Japan ..... 5-329947

[51] Int. Cl.[6] ..... H01J 29/48

[52] U.S. Cl. ..... 313/409; 313/414; 313/456; 313/460

[58] Field of Search ..... 313/409, 414, 313/417, 444, 456, 458, 460

[56] References Cited

U.S. PATENT DOCUMENTS 3,500,520 3/1970 Oess .
4,370,593 1/1983 Sweigart et al. ..... 313/409 X
4,546,287 10/1985 Collins et al. ..... 313/414 X
4,900,978 2/1990 Shimaohgi et al. ..... 313/458 X
5,015,910 5/1991 Takahashi et al. ..... 313/414 X

FOREIGN PATENT DOCUMENTS 0234340 9/1987 European Pat. Off. .
0454215 10/1991 European Pat. Off. .
837470 2/1939 France .
0182497 11/1982 Japan .
0218743 11/1985 Japan .
802108 10/1958 United Kingdom .

*Primary Examiner*—Sandra L. O'Shea
*Assistant Examiner*—Ashok Patel
*Attorney, Agent, or Firm*—Hill, Steadman & Simpson

[57] ABSTRACT

In an electron gun for a CRT in which a plurality of cylindrical electrodes are arranged and fixed in series to control a path of electron beams emitted from a cathode, a cylindrical support member is disposed between at least two adjacent cylindrical electrodes so that the two cylindrical electrodes are arranged coaxially. One end portion of the cylindrical support member and one cylindrical electrode are fixed to each other by fitting the former into the latter or vice versa, and the other end portion of the cylindrical support member and the other cylindrical electrode are fixed to each other by fitting the former into the latter or vice versa.

6 Claims, 13 Drawing Sheets

ELECTRON GUN FOR CRT

BACKGROUND OF THE INVENTION

1. Field of the Invention

The present invention relates to an electron gun for use in CRTs (cathode ray tubes) such as a projection tube, a color picture tube and an index tube and, more specifically, to an electron gun in which a plurality of electrode members are coaxially unified with high accuracy.

2. Description of the Prior Art

Conventionally, uni-potential electron guns are widely used for CRTs. FIG. 16 is a schematic sectional view of a uni-potential electron gun. As shown in FIG. 16, the uni-potential electron gun consists of a cathode K for emitting an electron beam, a first grid $G_1$ and a second grid $G_2$ that constitute, in combination with the cathode K, a cathode-grid lens, a third grid $G_3$ that constitutes, in combination with the second grid $G_2$, a pre-focus lens, and a fourth grid $G_4$ and a fifth grid $G_5$ that constitute, in combination with the third grid $G_3$, a main focus lens. In general, each grid is a cylindrical member made of metal.

In manufacturing the above type of electron gun, the centers of the respective grids need to be positioned on the same axis. To arrange and unify the respective grids, in general, the respective grids are positioned by the outside-diameter reference method and then unified by the glass beading method. This assembling method is described below in detail.

First, as shown in FIG. 17A, a beading jig 100 is prepared on which a plurality of grids having different outside diameters and shapes, for instance, grids $G_n$ and $G_{n+1}$ are to be placed. The beading jig 100 has mounting bases $A_n$ and $A_{n+1}$ which have been produced by using the outside diameters of a plurality of grids as references so that the grids are rendered coaxial when they are mounted thereon.

Then, as shown in FIG. 17B, the grids $G_n$ and $G_{n+1}$ are mounted on the respective mounting bases $A_n$ and $A_{n+1}$.

Then, softened bead glasses BG are pressed against fixing parts $B_n$ and $B_{n+1}$ of the respective grids $G_n$ and $G_{n+1}$ so that tip portions of the fixing parts $B_n$ and $B_{n+1}$ are buried in the bead glasses BG. The grids $G_n$ and $G_{n+1}$ are fixed to and unified with each other by subsequent cooling (see FIG. 17C).

However, where the grids are coaxially fixed to and unified with each other by the glass beading method with their outside diameters used as references, because of the outside-diameter reference scheme, a maximum axial deviation equal to a sum of outside diameter allowances of two adjacent grids, for instance, will occur between the center axes of those grids. For example, as shown in FIG. 18, where the outside diameter of each of two grids $G_n$ and $G_{n+1}$ has a standard 16±0.05 mm (allowance 0.05 mm), an axial deviation S between the grids $G_n$ and $G_{n+1}$ amounts to 0.05×2= 0.1 mm at the maximum if surfaces of mounting bases $A_n$ and $A_{n+1}$ of a beading jig 100 are on the same level. This type of axial deviation distorts an electron beam locus and increases lens aberrations. As a result, the size and shape of an electron beam spot on a phosphor screen of a CRT deviate from desired ones, causing a reduction of the resolution.

Further, where grids are fixed to and unified with each other by the glass beading method, since discharging likely occurs between a beading glass and a grid, it is difficult to obtain a high withstand voltage. Although limitations have been imposed on an arrangement of grids and bead glasses and distances between grids have been reduced to prevent the above discharging, the latter attempt has resulted in a new problem that discharging likely occurs between the grids.

SUMMARY OF THE INVENTION

The present invention has been made to solve the above problems in the prior art, and has an object of providing an electron gun for a CRT in which cylindrical members such as grids can be fixed to and unified with each other without causing an axial deviation, to thereby improve the resolution.

Another object of the invention is to provide an electron gun for a CRT in which cylindrical members such as grids can be fixed to and unified with each other without using bead glasses, to prevent discharging between a cylindrical member and a bead glass, to thereby improve a withstand voltage of the electron gun.

The present inventors have discovered the following and have completed the invention. That is, two cylindrical electrodes can be fixed to and unified with each other without using bead glasses by disposing a cylindrical support member between the two cylindrical electrodes and fitting an end portion of the cylindrical support member into the cylindrical electrode or vice versa so that the cylindrical support member and the cylindrical electrode are fixed to and unified with each other. In particular, where both end portions of the cylindrical support member are fitted into the cylindrical electrodes, they can be fixed to and unified with each other by the inside-diameter reference method. As a result, the axial deviation can be much reduced, and they can be fixed to and unified with each other with high positional accuracy.

That is, the invention provides an electron gun for a CRT in which a plurality of cylindrical electrodes are arranged and fixed in series to control a path of electron beams emitted from a cathode, and which is characterized in that a cylindrical support member is disposed between at least two adjacent cylindrical electrodes so that the two cylindrical electrodes are arranged coaxially, and that one end portion of the cylindrical support member and one cylindrical electrode are fixed to each other by fitting the former into the latter or vice versa, and the other end portion of the cylindrical support member and the other cylindrical electrode are fixed to each other by fitting the former into the latter or vice versa.

DESCRIPTION OF THE PREFERRED EMBODIMENTS

Embodiments of the present invention will be hereinafter described with reference to the accompanying drawings.

Figure 1A:
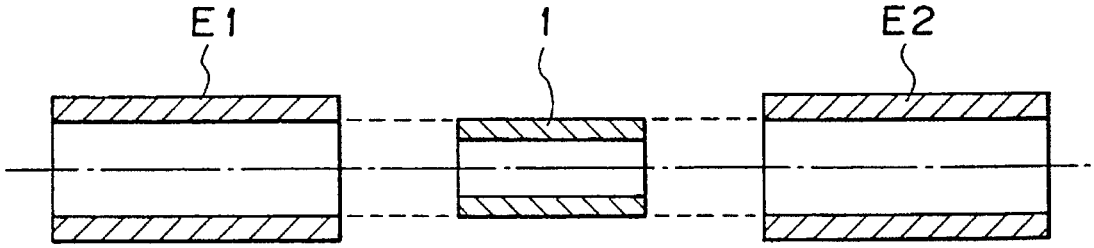
FIGS. 1A and 1B illustrate how adjacent cylindrical electrodes are connected to each other in the present invention.
Figure 1B:
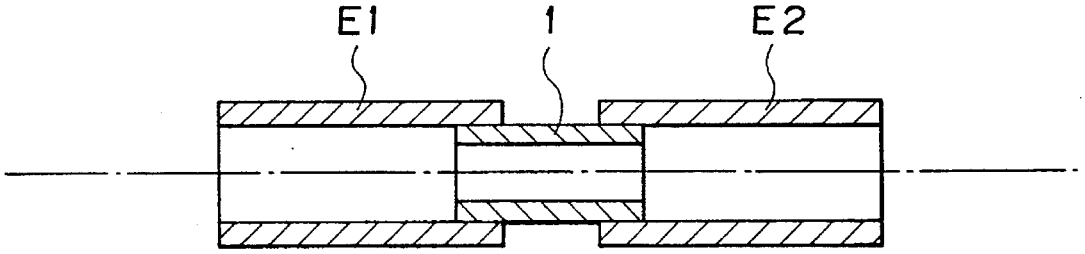
Figure 1C:
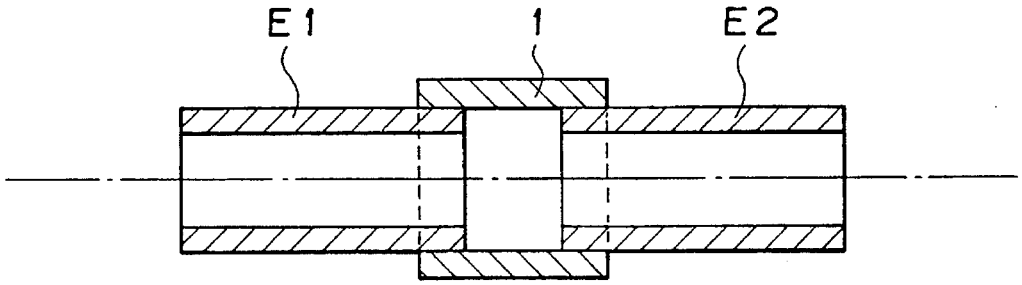
FIG. 1C shows an example of a connecting structure for fixing and unification of two cylindrical electrodes in the invention.

In an electron gun according to the invention, at least two adjacent cylindrical electrodes among a plurality of cylindrical electrodes, such as grids, that constitute the electron gun are unified with each other in the following manner. When two cylindrical electrodes have the same inside diameter, in one method (see FIG. 1A), a cylindrical support member 1 having a uniform outside diameter is coaxially disposed between two cylindrical electrodes (grids) E1 and E2. Then, as shown in FIG. 1B, the cylindrical electrodes E1 and E2 are fixed to and unified with each other by fitting both end portions of the cylindrical support member 1 into the cylindrical electrodes B1 and B2. In another method, as shown in FIG. 1C, the cylindrical electrodes E1 and E2 are fixed to and unified with each other by fitting the cylindrical electrodes E1 and E2 into both end portions of a cylindrical support member 1 having a uniform diameter.

Figure 2:
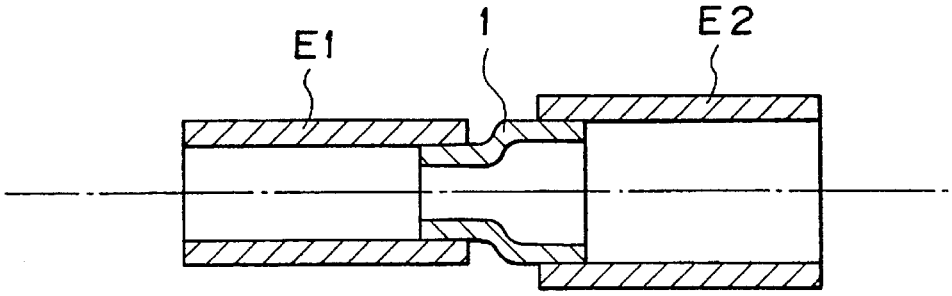
FIGS. 2–4 show other examples of connecting structures for fixing and unification of two cylindrical electrodes in the invention.

When two cylindrical electrodes E1 and E2 have different inside diameters, in one method (see FIG. 2), a cylindrical support member 1 whose end portions have different outside diameters is used, and the cylindrical electrodes E1 and E2 are fixed to and unified with each other by fitting both end portions of the cylindrical support member 1 into the cylindrical electrodes E1 and E2. In another method (see FIG. 3), the cylindrical electrodes E1 and E2 are fixed to and unified with each other by fitting one end of a cylindrical support member 1 into the cylindrical electrode E1 and fitting the cylindrical electrode E2 into the other end portion of the cylindrical support member 1. In still another method (see FIG. 4), the cylindrical electrodes E1 and E2 are fixed to and unified with each other by fitting those electrodes into both end portions of a cylindrical support member 1.

Because no bead glass is needed to connect two cylindrical electrodes, the problem of discharging between a cylindrical electrode and a bead glass can be solved to enable increase of the withstand voltage of an electron gun.

In particular, when the cylindrical support member 1 is coaxially disposed between the two cylindrical electrodes E1 and E2 and both end portions of the cylindrical support member 1 are fitted into the cylindrical electrodes E1 and E2 (see FIGS. 1A and 1B and FIG. 2), the cylindrical electrodes E1 and E2 can be fixed to and unified with each other by the inside-diameter reference method. This allows a number of cylindrical electrodes to be fixed to and unified with each other coaxially with high accuracy.

Figure 5A:
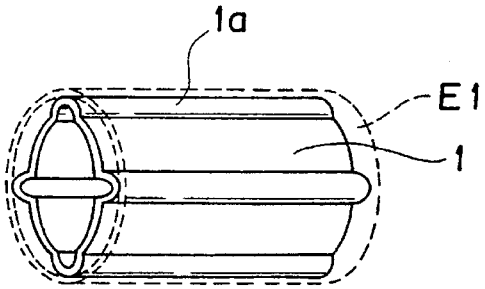
FIGS. 5A and 5B show a cylindrical support member and a cylindrical electrode, respectively, used in the invention.
Figure 5B:
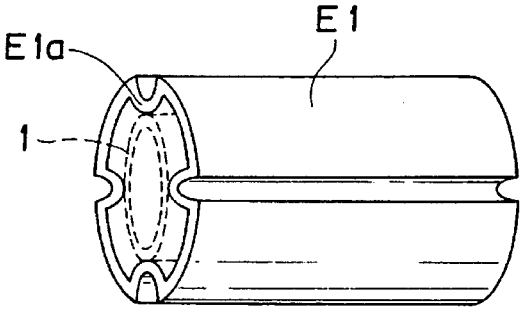

In this case, it is preferred that a contact surface of one of the cylindrical support member and the cylindrical electrode that are to be brought into contact with each other be formed with protrusions (embosses) that will press against the opposed contact surface. For example, as shown in FIG. 5A, the outer surface of the cylindrical support member 1 to be fitted into the cylindrical electrode E1 is formed with protrusions E1*a* that will press against the inner wall of the cylindrical electrode E1. Alternatively, as shown in FIG. 5B, the inner wall of the cylindrical electrode E1 into which the cylindrical support member 1 is to be fitted is formed with protrusions E1*a* that will press against the cylindrical support member 1. With these structures, the cylindrical support member 1 can be fitted into the cylindrical electrode E1 while the protrusions are deformed, without impairing the concentricity of the cylindrical portion of the cylindrical support member 1. Therefore, it becomes possible to increase the strength a unified structure without causing an axial deviation. Even where an inside diameter allowance is in the same level as an outside diameter allowance, deformations of the protrusions can compensate for the inside diameter allowance.

In the following, electron guns for a CRT according to embodiments of the invention will be described in a more specific manner.

Figure 6:
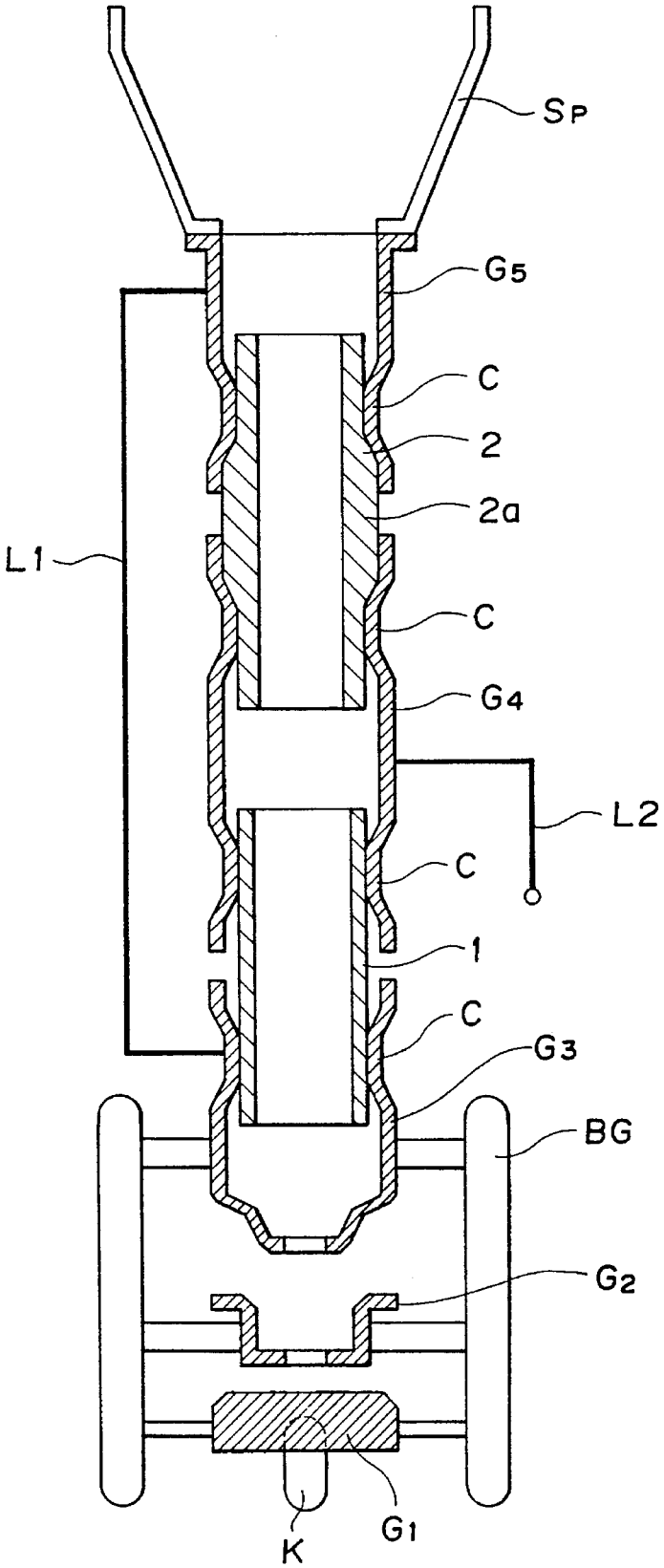
FIG. 6 is a sectional view of a uni-potential electron gun for a CRT according to an embodiment of the invention.

FIG. 6 is a sectional view of a uni-potential electron gun for a CRT according to an embodiment of the invention. In the electron gun for a CRT of this embodiment, there are arranged a cathode K for emitting thermoelectrons, and first to fifth grids $G_1$–$G_5$ made of metal. Among those components, the first to third grids $G_1$–$G_3$ are unified with each other by means of bead glasses BD. Fixed to the fifth grid $G_5$ is HV springs Sp which press against the inner wall of a neck tube (not shown) so that the electron gun is held by the neck tube, and which allow application of an anode high voltage (supplied from an anode button through a carbon conductive film that is applied to the inner wall of the neck tube) to the fifth grid $G_5$. The third grid $G_3$ is connected to the fifth grid $G_5$ by a lead L1 so that these grids have the same potential. The fourth grid $G_4$ is supplied, through a lead L2, with a much lower voltage than the third grid $G_3$.

In this embodiment, the third grid $G_3$ and the fourth grid $G_4$ are fixed to each other by the inside-diameter reference method by fitting a cylindrical support member 1 having uniform inside and outside diameters into those grids. And the fourth grid $G_4$ and the fifth grid $G_5$ are fixed to each other by the inside-diameter reference method by fitting, into those grids, a cylindrical support member 2 in which the inside diameter is uniform but the outer surface is formed with a protrusion 2*a*.

The inner surfaces of the third to fifth grids $G_3$–$G_5$ that are in contact with the cylindrical support member 1 or 2 are formed with protrusions C. The protrusions C press against the inserted cylindrical support member, and are deformed to increase the strength of the unification between the cylindrical support members 1 and 2 and the grids $G_3$–$G_5$. The protrusions C may be provided over the entire circumferences of the grids $G_3$–$G_5$, or provided discretely (i.e., so as to assume spot-like shapes) in axial symmetry. The latter structure is preferable because the protrusions C are deformed more uniformly.

On the other hand, the protrusion 2*a* formed on the outer surface of the cylindrical support member 2 is adapted to engage the protrusions C of the grids $G_4$ and $G_5$. The formation of the protrusion 2*a* in this manner is preferable because it prevents the cylindrical support member 2 from being inserted into the grids $G_4$ and $G_5$ excessively.

Figure 7:
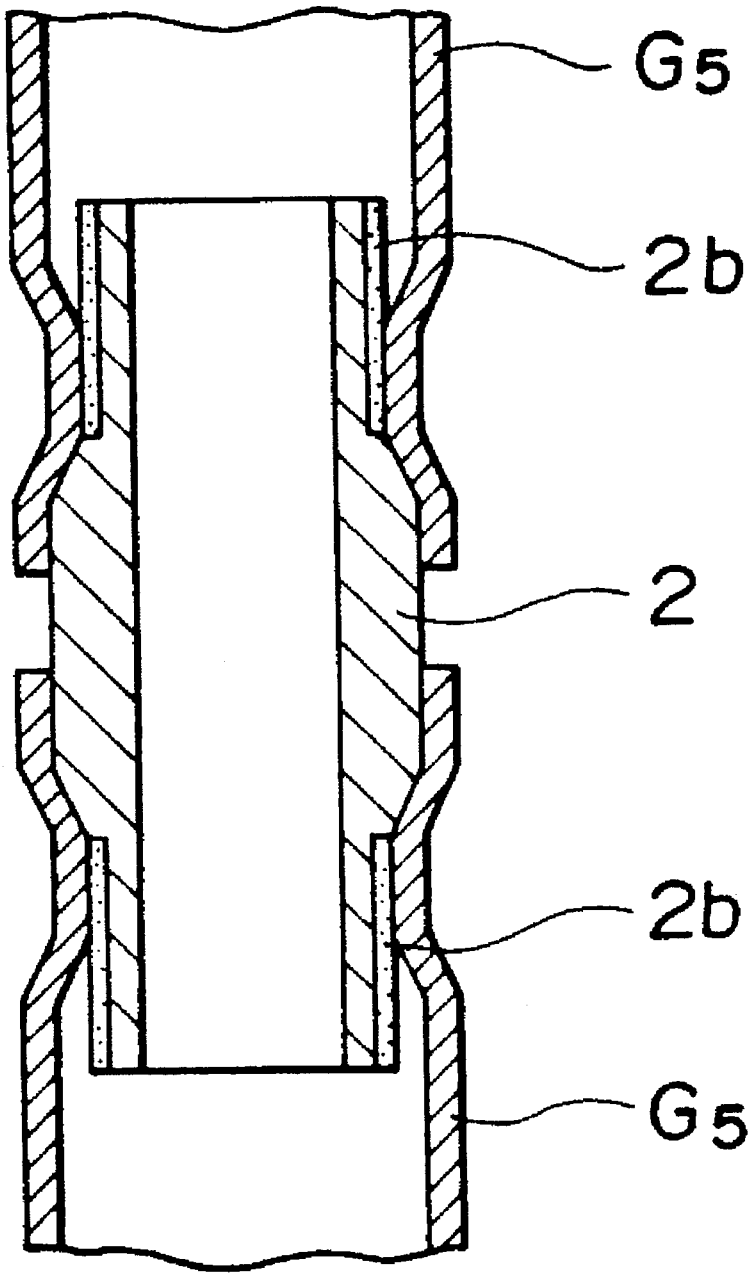
FIG. 7 is a partial sectional view showing a uni-potential electron gun for a CRT according to a modification of the embodiment of FIG. 6.

In this embodiment, it is preferred that the cylindrical support members 1 and 2 be made of insulative ceramics if charging-up in the electron gun is in a level of causing no problem, and if the potentials of the respective grids are relatively low and differences therebetween are not large. Where the differences between the potentials of the respective grids are large to cause a charging-up problem in the electron gun, it is preferred that the cylindrical support members 1 and 2 be made of high-resistivity conductive ceramics. This will reduce a potential gradient between the adjacent grids to prevent an unstable variations of an intermediate potential distribution between the adjacent grids. Where the differences between the potentials of the respective grids are large to cause a charging-up problem in the electron gun, it is preferred that annular conductive films 2*b* be further formed on the outer surfaces of both end portions which are fitted into the fourth and fifth grids $G_4$ and $G_5$, as in the case of a cylindrical support member 2 shown in FIG. 7.

Figure 8:
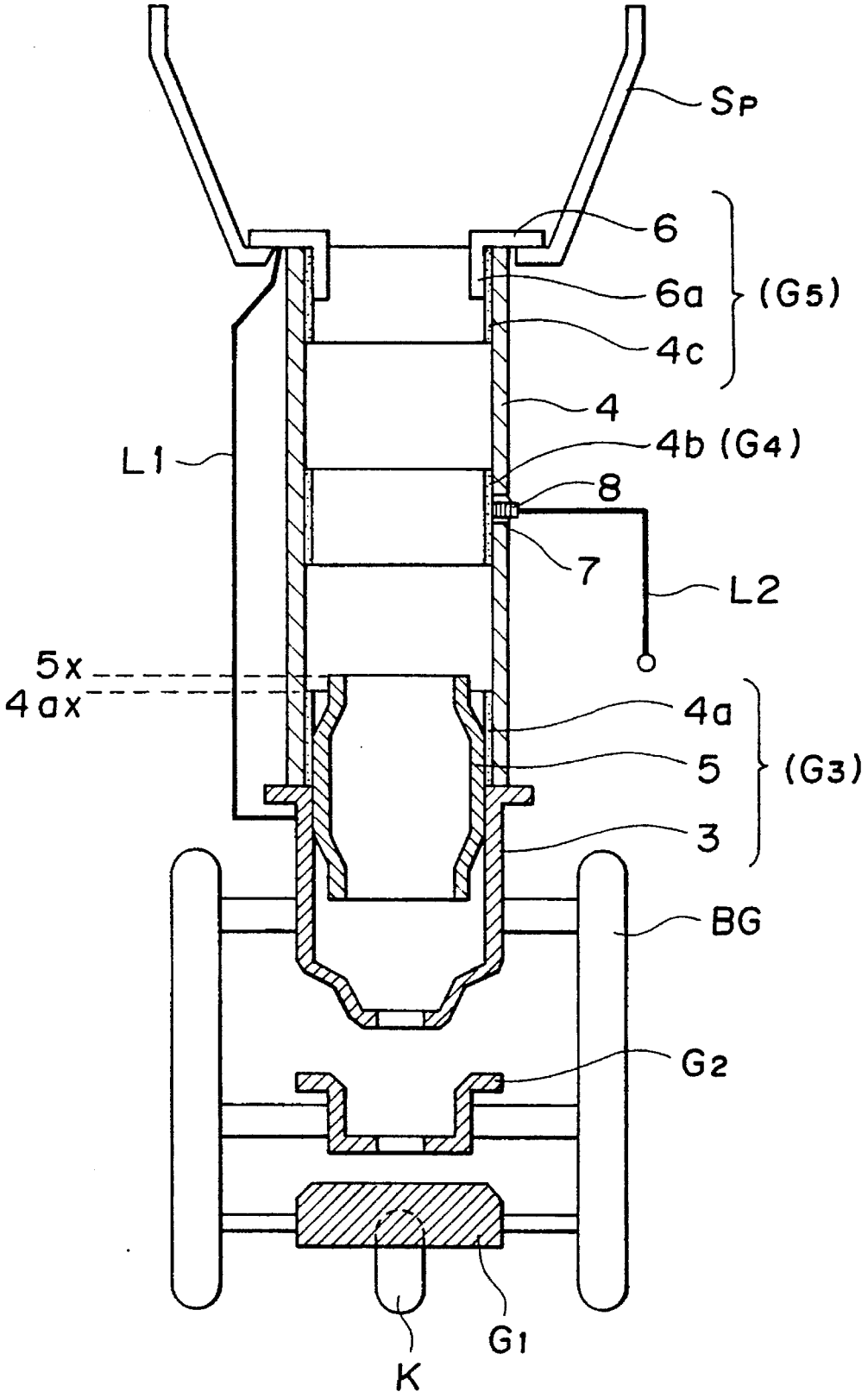
FIG. 8 is a sectional view of a uni-potential electron gun for a CRT according to another embodiment of the invention.
Figure 9A:
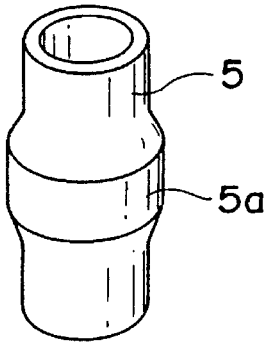
FIGS. 9A–9F are perspective views of cylindrical electrodes used in the invention.
Figure 9B:
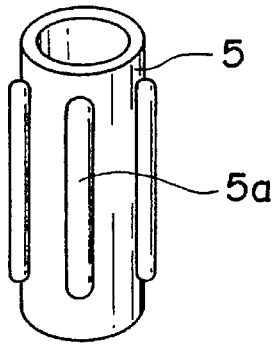
Figure 9C:
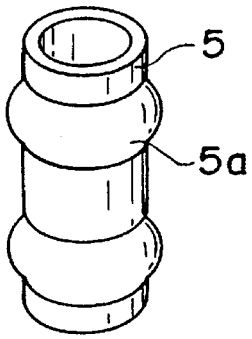
Figure 9D:
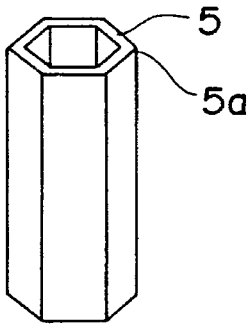
Figure 9E:
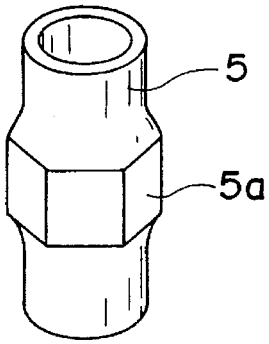
Figure 9F:
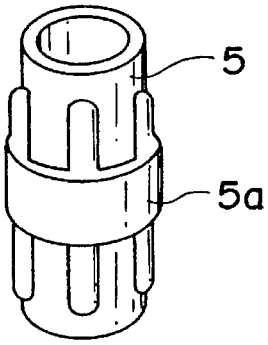

FIG. 8 is a sectional view of a uni-potential electron gun for a CRT according to another embodiment of the invention. In this embodiment, this invention is applied to the electron gun in which third to fifth grids $G_3$–$G_5$ are provided on the inner wall of a single cylindrical insulative member 4 in the form of conductive films (U.S. patent application Ser. No. 08/172,733 of the present assignee filed Dec. 27, 1993), to further improve the concentricity of the grids $G_3$–$G_5$, which constitute a main focus lens.

As shown in FIG. 8, in the electron gun for a CRT according to this embodiment, a cathode K for emitting thermoelectrons, first and second metal grids $G_1$ and $G_2$, and a cup member 3 are arranged coaxially and unified by use of bead glasses BG. The cup member 3 is a cylindrical member made of a metal such as stainless steel, and serves as an electrode.

The cylindrical insulative member (support member) 4 has a cylindrical shape of a high circularity (for instance, less than 150 μm), and is made of, for example, insulative ceramics such as alumina or high-resistivity conductive ceramics. An annular conductive film 4*a* made of a $RuO_2$-glass paste is formed on an inner wall portion of the cylindrical insulative member 4 on the side of the cup member 3. An electrode film 4*b* is formed on an inner wall portion above the conductive film 4*a*, and an electrode film 4*c* is formed on an inner wall portion above the electrode film 4*b*. The electrode film 4*a*, together with the cup member 3 and a cylindrical electrode 5 (described later), serves as the third grid (cylindrical electrode) $G_3$. The conductive film 4*b* serves as the fourth grid (cylindrical electrode) $G_4$. The conductive film 4*c*, together with a HV shield 6 (described later), as the fifth grid $G_5$. The electrode films 4*a* and 4*c* are connected to each other by a lead L1 so as to have the same potential. The electrode film 4*b* and a lead L2 are connected to a pin 8 that is inserted in a pin hole 7 of the cylindrical insulative member 4 by glass fusing. Thus, a prescribed potential is applied to the electrode film 4*b*. It is preferred that the pin 8 be made of covar iron or a titanium alloy each of which has a thermal expansion coefficient close to that of a ceramic material constituting the cylindrical insulative member 4.

In this embodiment, the cup member 3 and the cylindrical insulative member 4 that is formed with the third to fifth grids $G_3$–$G_5$ are fixed to and unified with each other by the inside-diameter reference method by fitting into those members the cylindrical electrode 5 made of a metal material such as stainless steel which electrode is a part of the third grid $G_3$.

Figure 10A:
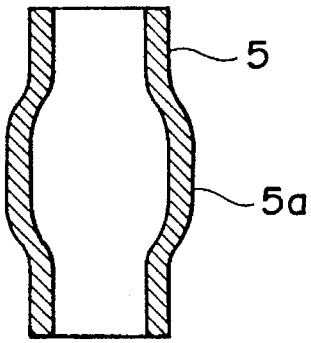
FIGS. 10A and 10B are sectional views of cylindrical electrodes used in the invention.
Figure 10B:
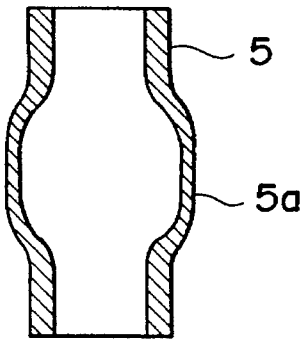

FIGS. 9A–9F show examples of the shape of the cylindrical electrode 5 for the third grid $G_3$, in each of which the outer surface is formed with a protrusion or protrusions 5*a*. The protrusion 5*a* may either have the same thickness as the other portion (see FIG. 10A), or be thinner than the other portion (see FIG. 10B). In either case, since the protrusion or protrusions 5*a* are pressed inward and uniformly contracted when the cylindrical electrode 5 is fitted into the cylindrical insulative member 4 and the cup member 3, the cup member 3, the cylindrical electrode 5 and the cylindrical insulative member 4 can be strongly unified with each other. In particular, the example of FIG. 10A in which the protrusion 5*a* is made thinner than the other portion is preferred, because the protrusion 5*a* is easily deformed when the cylindrical electrode 5 for the third grid $G_3$ is fitted into the cylindrical insulative member 4 and the cup member 3, to thereby prevent deformation of the cylindrical portion (main body) of the cylindrical electrode 5 for the third grid $G_3$.

While strength of the unification can be improved by the cylindrical electrode 5 for the third grid $G_3$ being formed with the protrusion or protrusions 5*a*, it may further be improved if necessary by joining together, by spot welding, the cup member 3 and the cylindrical electrode 5 that constitute the third grid $G_3$.

The cylindrical electrode 5 for the third grid $G_3$ having the above structure may be produced either by forming a single metal material, or welding together flanges of two cylindrical members as in the case of cylindrical electrodes shown in FIGS. 15B–15D (described later).

In fitting the cylindrical electrode 5 for the third grid $G_3$ into the cylindrical insulative member 4 for fixing of those members, it is preferred that an end 5*x* of the cylindrical electrode 5 for the third grid $G_3$ be closer to the electrode film 5*b* than an end 4*ax* of the electrode film 4*a* (see FIG. 8) for the following reason. To improve accuracy of the third grid $G_3$, it is desired that the top end of the electrode member that constitutes the top portion of the third grid $G_3$, i.e., the end 5*x* of the cylindrical electrode 5 or a plane including the end 4*ax* of the electrode film 4*a* be perpendicular to the tube axis of the cylindrical insulative member 4. While it is generally difficult to make the plane including the end 4*ax* of the electrode film 4*a* perpendicular to the tube axis of the cylindrical insulative member 4, the end 5*x* of the cylindrical electrode 5 for the third grid $G_3$ can easily be made perpendicular to the tube axis of the cylindrical insulative member 4.

Figure 11:
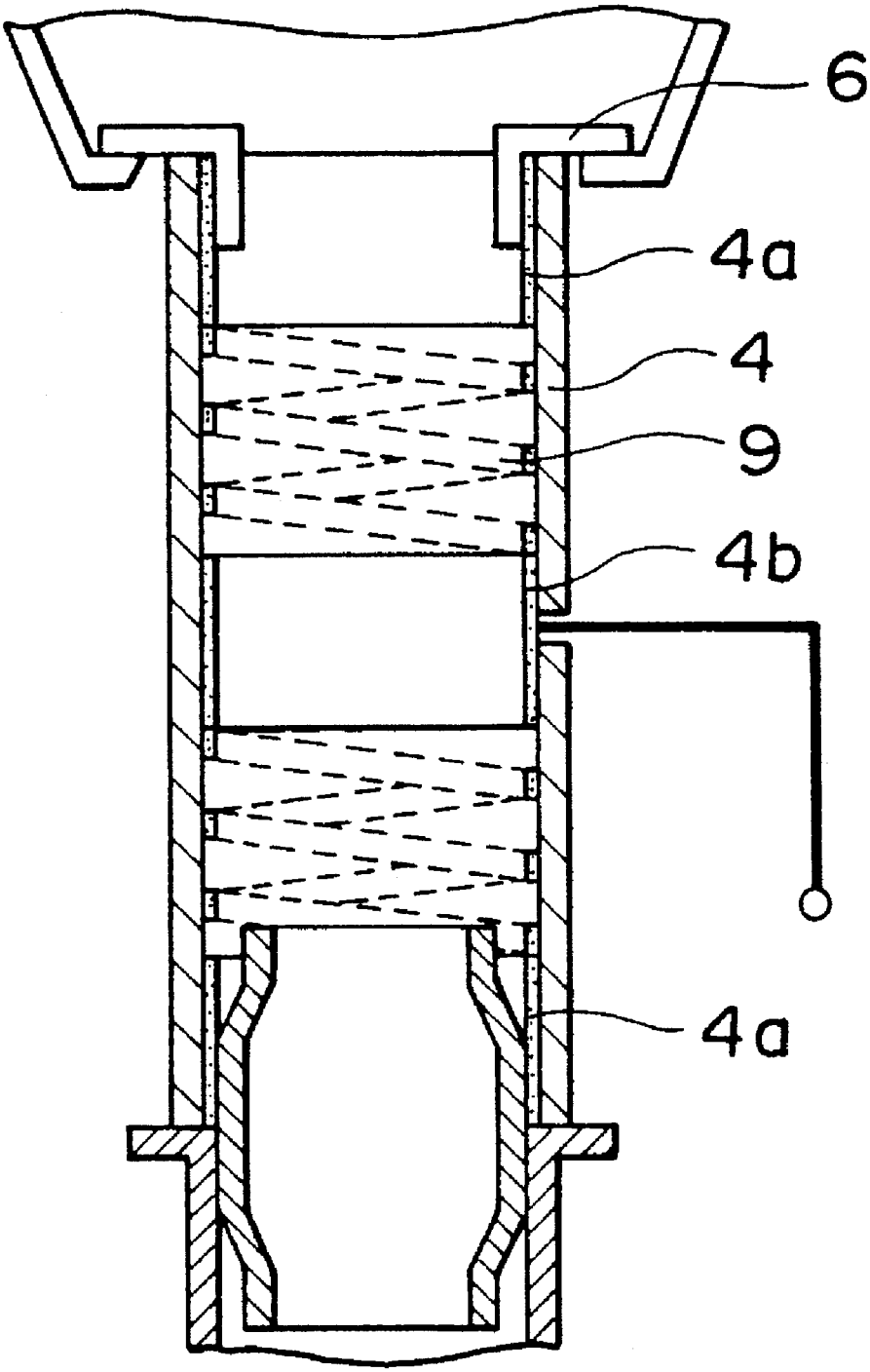
FIG. 11 is a partial sectional view showing a uni-potential electron gun for a CRT according to another embodiment of the invention.
Figure 12A:
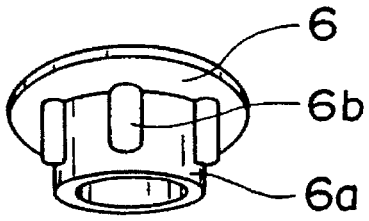
FIGS. 12A–12E are perspective views of HV shields used in the invention.
Figure 12B:
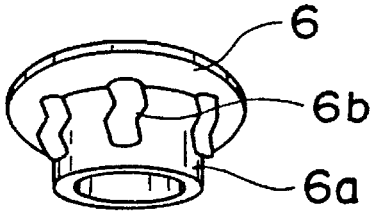
Figure 12C:
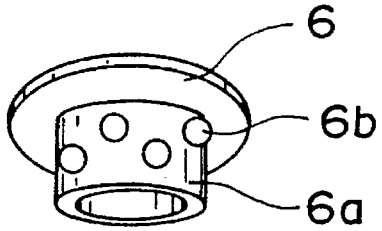
Figure 12D:
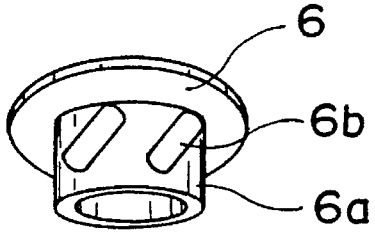
Figure 12E:
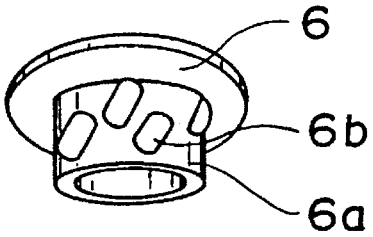

In the above embodiment, where the cylindrical insulative member 4 is made of insulative ceramics rather than high-resistivity conductive ceramics, it is preferred that a helical resistor film 9 be provided between the electrode films 4*a* and 4*b* and between the electrode films 4*b* and 4*c* so as to connect those electrode films (see FIG. 11). This will reduce the potential gradient between those electrode films to thereby enable stabilization of the intermediate potential distribution.

In the embodiment of FIG. 8, a HV shield 6 made of stainless steel, for instance, is fitted into a top portion of the cylindrical insulative member 4. Further, HV springs Sp which press against the inner wall of a neck tube (not shown) so that the electron gun is held by the neck tube, and which allow application of an anode voltage (supplied from an anode button through a carbon conductive film that is applied to the inner wall of the neck tube) to the HV shield 6 is spot-welded to the HV shield 6. It is preferred that the outer surface of a fitting portion 6*a* of the HV shield 6 be formed with protrusions 6*b* as shown in FIGS. 12A–12E. In this case, when the HV shield 6 is fitted into the cylindrical insulative member 4, the protrusions 6*b* are pressed and contracted uniformly to thereby increase strength of the unification of the HV shield 6 and the insulative member 4. The protrusion 6*b* may be provided over the entire circumference of the fitting portion 6*a*. Alternatively, the protrusions 6*b* may be provided discretely (i.e., so as to assume spot-like shapes) in axial symmetry. The latter structure is preferable because the protrusions 6*b* are contracted more uniformly.

Figure 13:
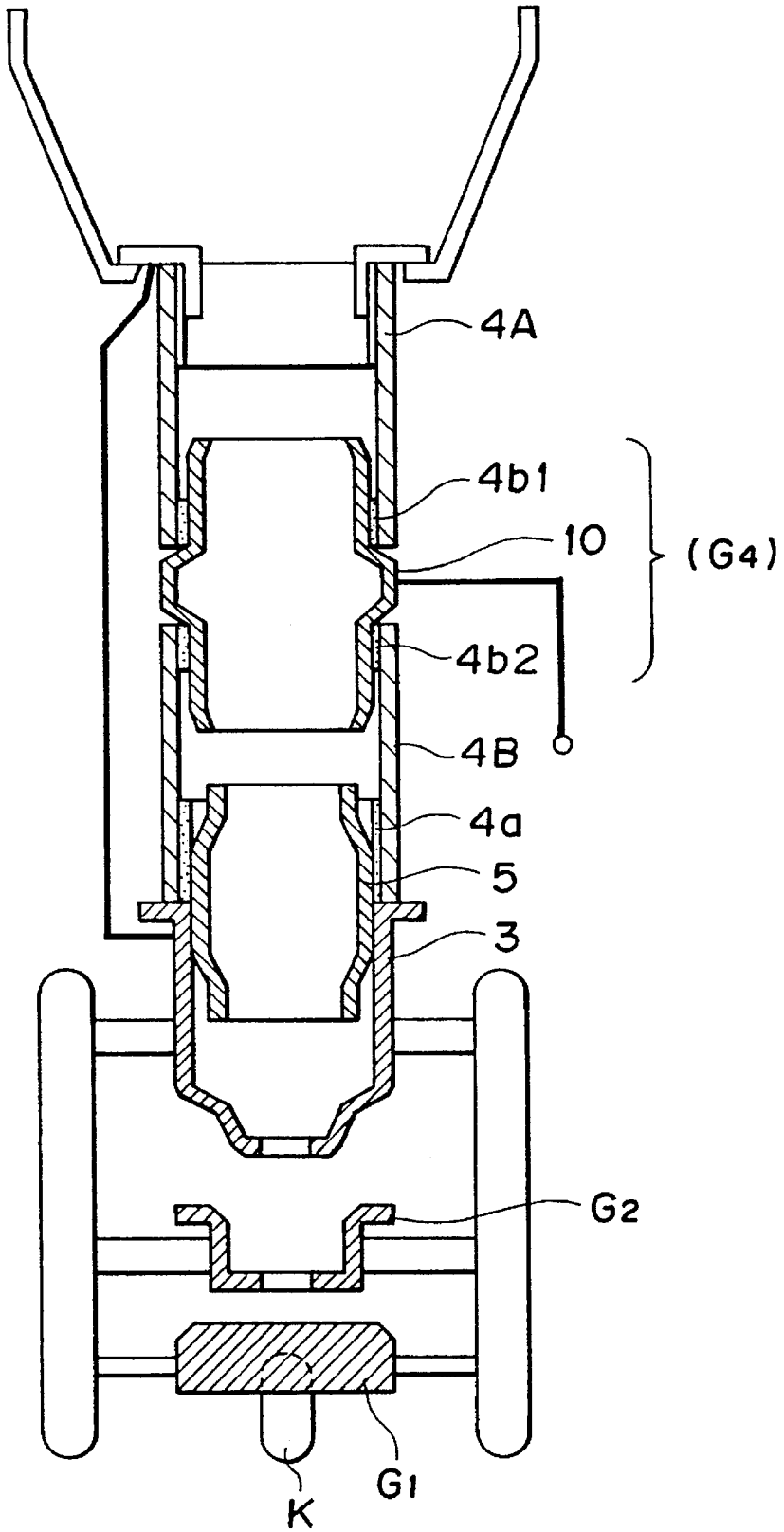
FIG. 13 is a sectional view of a uni-potential electron gun for a CRT according to another embodiment of the invention.

FIG. 13 is a sectional view showing a uni-potential electron gun for a CRT according to another embodiment of the invention. In this embodiment, the cylindrical insulative member (cylindrical support member) 4 in the embodiment of FIG. 8 is divided into two cylindrical insulative members 4A and 4B, into which a cylindrical electrode 10 made of a metal material is fitted. The cylindrical insulative member 4B holds the electrodes 5 and 10.

An electrode film 4*b*1 is formed on an inner surface portion of the cylindrical insulative member 4A on the side of the cylindrical electrode 10, and an electrode film 4*b*2 is formed on an inner surface portion of the cylindrical insulative member 4B on the side of the cylindrical electrode 10. The elect:rode films 4*b*1 and 4*b*2 and the cylindrical electrode 10 constitute a fourth grid $G_4$. The division of the cylindrical insulative member 4 eliminates the need of forming the pin hole 7 through the cylindrical insulative member 4 (see FIG. 8), and allows the lead L2 to be directly welded to the cylindrical electrode 10. Further, the individual divided cylindrical insulative members 4A and 4B are shorter than the non-divided cylindrical insulative member 4 of FIG. 8. Therefore, where the cylindrical insulative members 4A and 4B are made of sintered ceramics, accuracy of the sintering can be improved to thereby provide an advantage that cutting margins of the members 4A and 4B can be reduced.

The cylindrical insulative members 4, 4A and 4B of FIGS. 8 and 13 can be produced by the same method as disclosed in U.S. patent application Ser. No. 08/172,733 of the present assignee filed Dec. 27, 1993.

Figure 3:
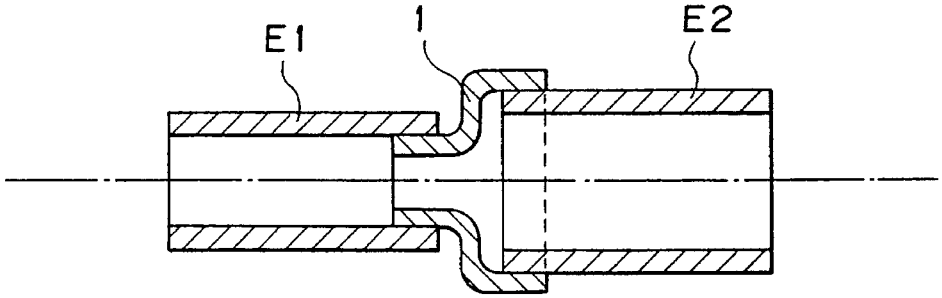
Figure 4:
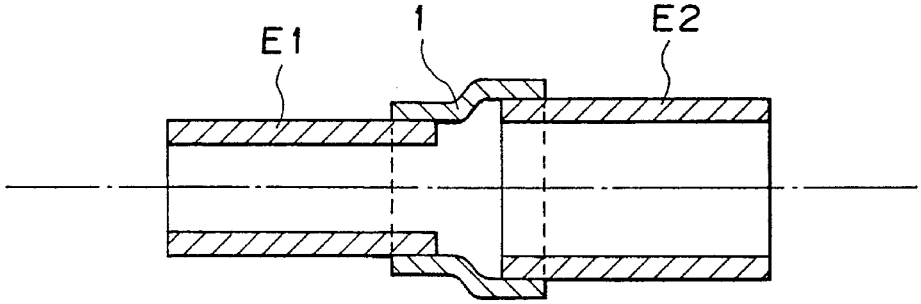
Figure 14:
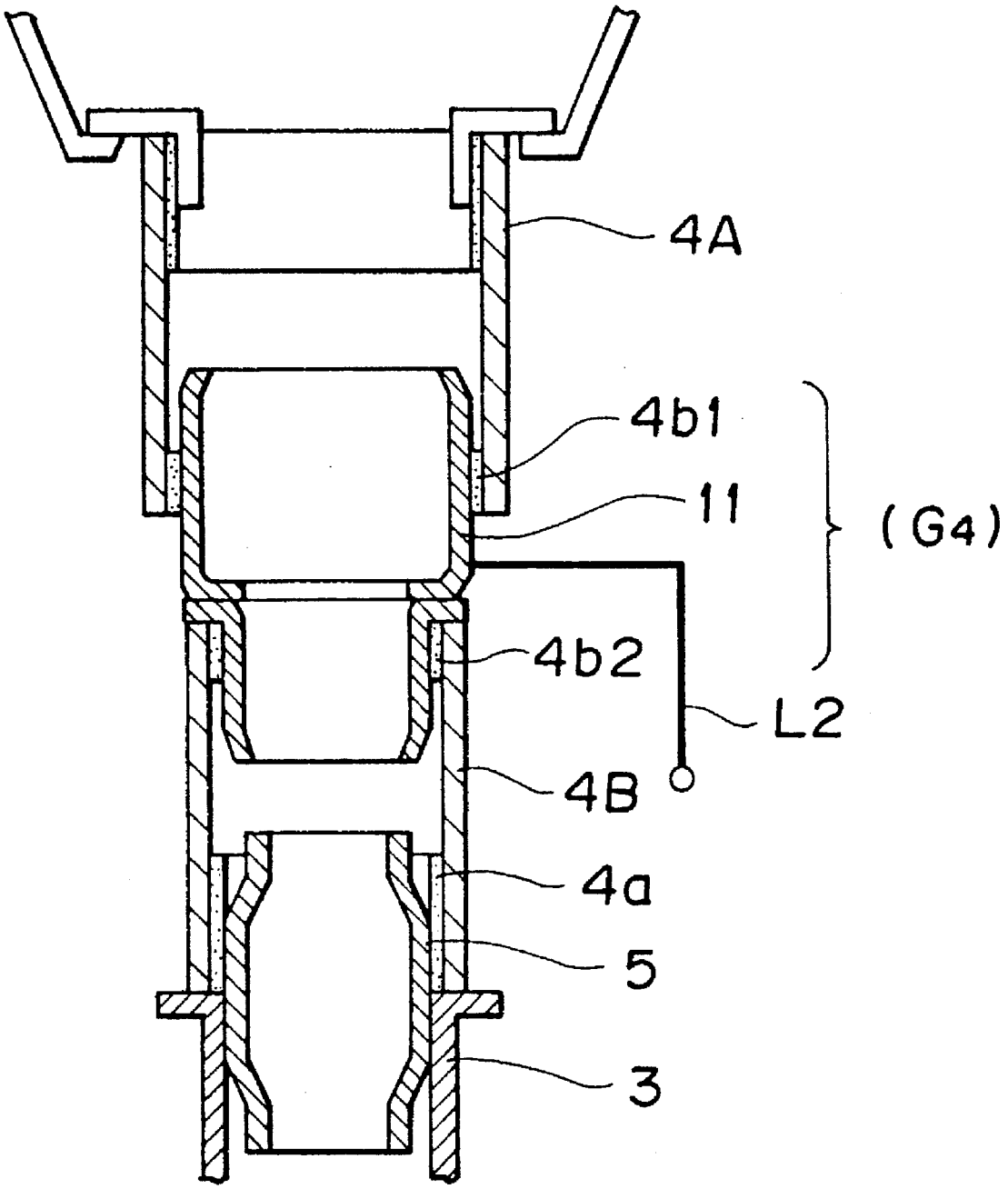
FIG. 14 is a partial sectional view showing a uni-potential electron gun for a CRT according to still another embodiment of the invention.

FIG. 14 shows an electron gun according to still another embodiment of the invention. In this embodiment, two cylindrical insulative members 4A and 4B have different diameters, and are fixed to and unified with each other such that a cylindrical electrode 11 whose two end portions have different outside diameters is fitted into one end portion of the cylindrical insulative member 4B and the cylindrical electrode 5 is fitted into the other end portion of the cylindrical insulative member 4B. Where two cylindrical members having different diameters are fixed to each other by use of a cylindrical electrode, both end portions of the cylindrical electrode 11 (or 1) of FIG. 14 (or 2) may be fitted into the cylindrical insulative members 4A and 4B (or E1 and E2). Alternatively, as shown in FIGS. 3 and 4, the cylindrical electrodes E1 and E2 may be fitted into one or both end portions of the cylindrical support member 1.

Figure 15A:
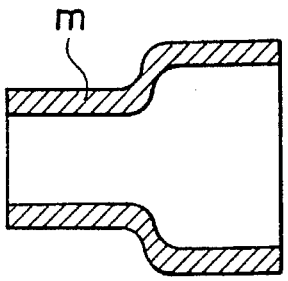
FIGS. 15A–15D are perspective views of cylindrical electrodes used in the invention.
Figure 15B:
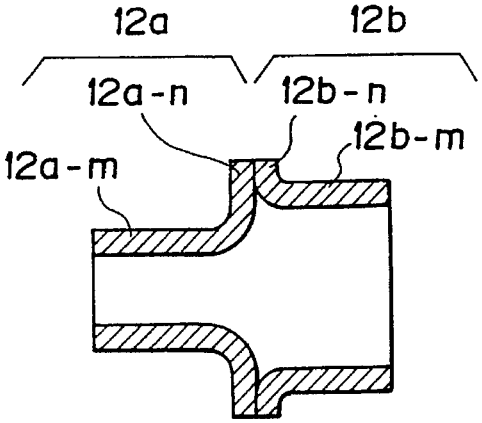
Figure 15C:
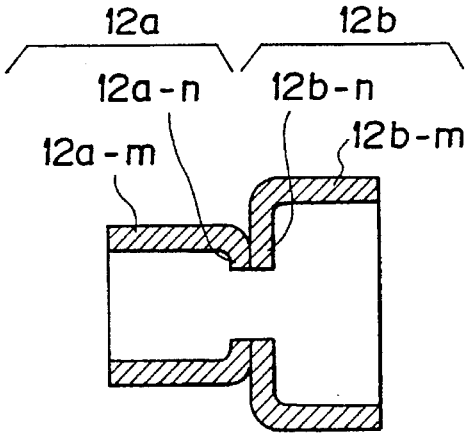
Figure 15D:
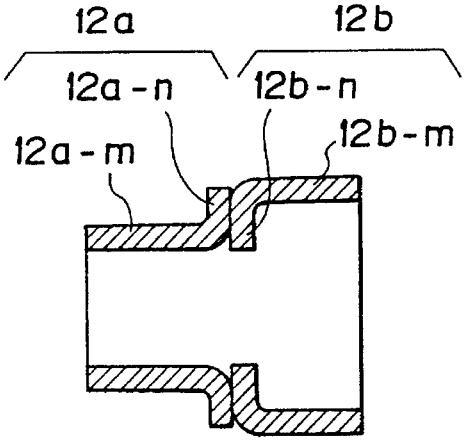
Figure 16:
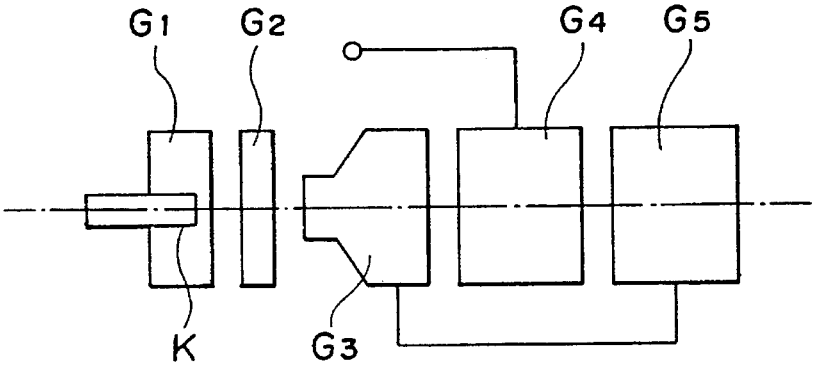
FIG. 16 (PRIOR ART)
FIG. 16 is a schematic sectional view of a conventional uni-potential electron gun.
Figure 17A:
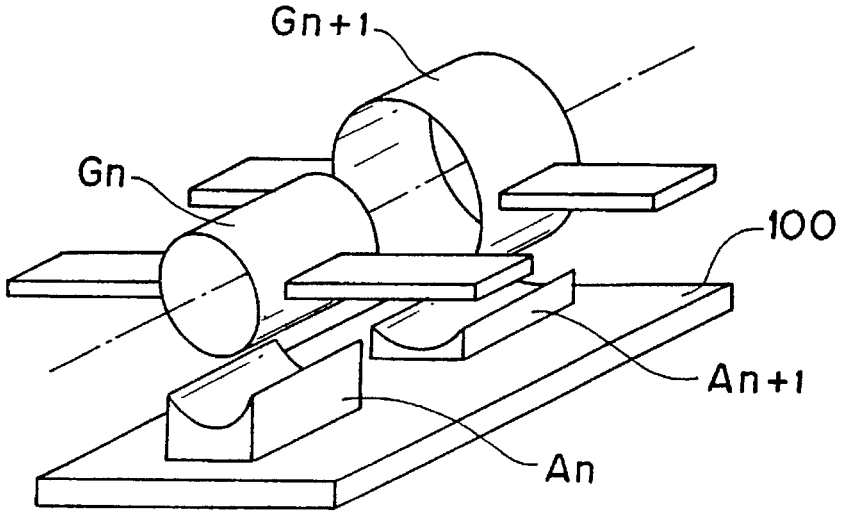
FIG. 17A (PRIOR ART)
FIGS. 17A–17C illustrates a glass beading method for fixing and unification of adjacent grids of a conventional electron gun.
Figure 17B:
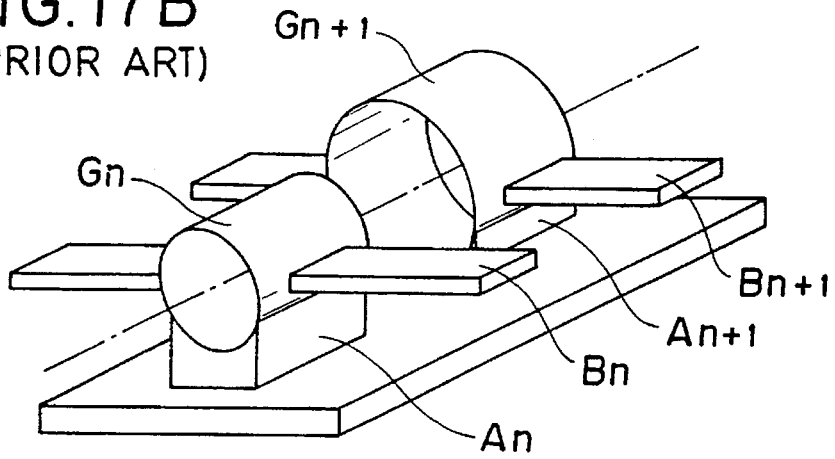
FIG. 17B (PRIOR ART)
Figure 17C:
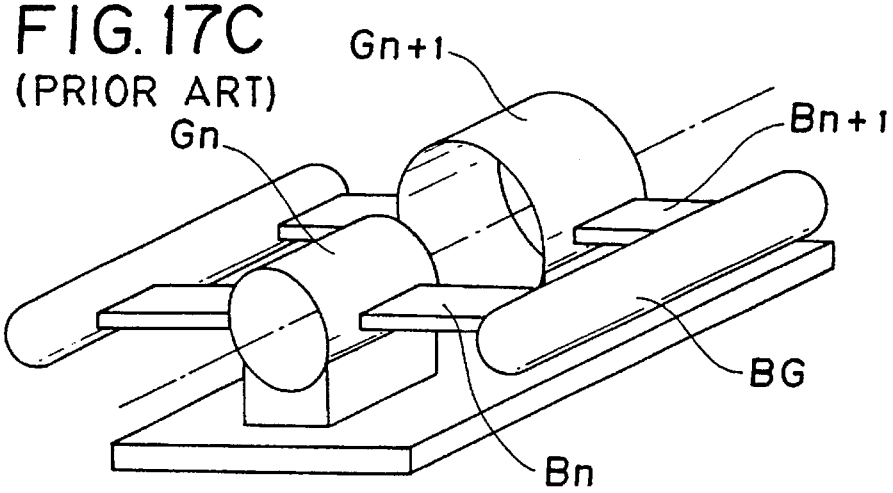
FIG. 17C (PRIOR ART)
Figure 18:
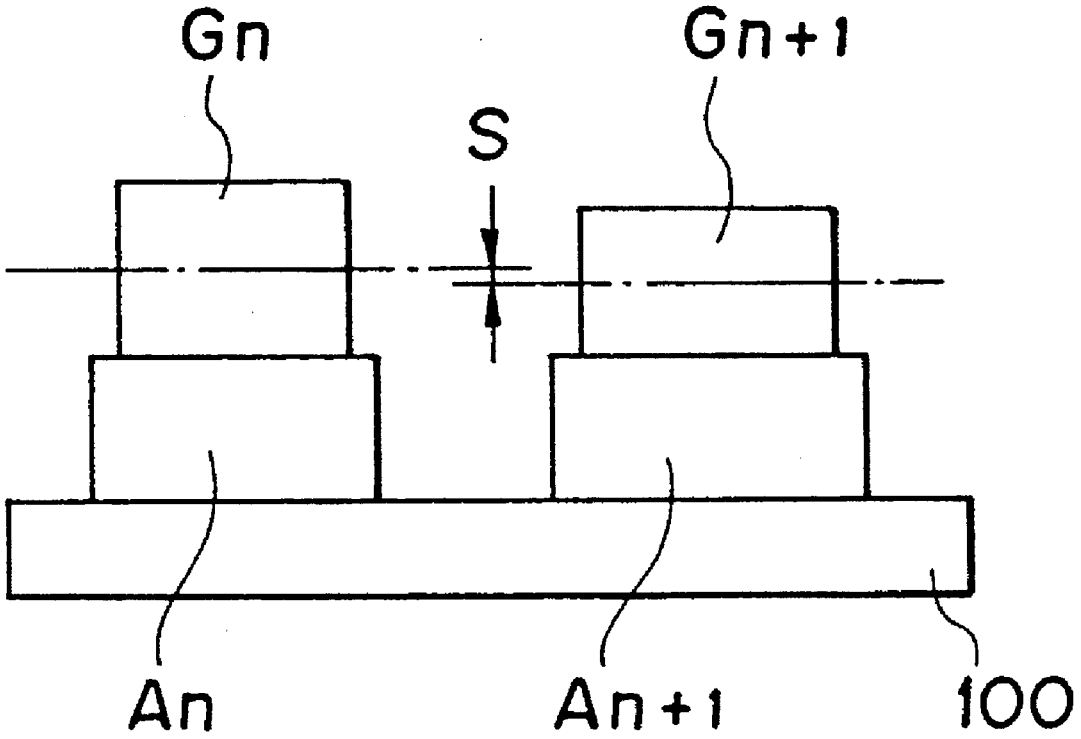
FIG. 18 (PRIOR ART)
FIG. 18 illustrates an axial deviation that occurs when adjacent grids are fixed to and unified with each other by the glass beading method.

More specifically, as shown in FIG. 15A, the cylindrical electrode to be used for the fixing and unification of two cylindrical members having different diameters may be a metal member that is formed using a single part so that the inside or outside diameter of a cylindrical portion m on each side is suitable for the diameter of a counterpart cylindrical member. Alternatively, as shown in FIGS. 15B–15D, there may be prepared two cylindrical electrodes 12*a* and 12*b* having respective flanges in which their cylindrical portions 12*a–m* and 12*b–m* have different inside or outside diameters. In this case, the flanges 12*a–n* and 12*b–n* are jointed together by welding, for instance.

Where the cylindrical electrode formed by joining together the flanges 12*a–n* and 12*b–n* of the two cylindrical electrodes 12*a* and 12*b* is used, two cylindrical members may be fixed to and unified with each other by using such a cylindrical electrode such that the flanges 12*a–n* and 12*b–n* of the two cylindrical electrodes 12*a* and 12*b* are preliminarily joined together and then the resulting cylindrical electrode is fixed to and unified with the two cylindrical members. Alternatively, the two cylindrical electrodes 12*a* and 12*b* having the respective flanges may be preliminarily fixed to and unified with the respective cylindrical members, followed by joining of the flanges 12*a–n* and 12*b–n*.

It is preferred that the outer surface of the cylindrical portion of each of the cylindrical electrodes shown in FIGS. 15A–15D be formed with a protrusion or protrusions as in the case of the cylindrical electrodes shown in FIGS. 9A–9F.

Although the above embodiments are directed to the case where a plurality of cylindrical electrodes, such as grids, that constitute the main focus lens of the uni-potential electron gun for a CRT are fixed to and unified with each other by use of the cylindrical support member, the invention is not limited to those embodiments but can be applied to the bi-potential electron gun for a CRT. Further, the invention can also be applied to the case where electrodes that constitute the cathode-grid lens or pre-focus lens are fixed to and unified with each other by the inside-diameter reference method.

According to the electron gun for a CRT of the invention, the axial deviation can be much reduced by enabling the cylindrical electrodes such as grids to be fixed to and unified with each other by the inside-diameter reference method. Therefore, the distortion of the electron beam locus can be suppressed and the lens aberrations can be reduced. As a result, desired electron beam spots can be obtained on the phosphor screen of a CRT, which means an improvement of the resolution.

According to the electron gun for a CRT of the invention, since no bead glass is needed when the cylindrical electrodes such as grids are fixed to and unified with each other, there can be avoided discharging between a cylindrical electrode such as a grid and a bead glass, contributing to an improvement of the withstand voltage of the electron gun.

What is claimed is:

1. An electron gun for a CRT in which a plurality of cylindrical electrodes are arranged in series to control a path of electron beams emitted from a cathode, comprising:

cylindrical electrode means adjacent to each other; and a cylindrical support member for supporting at least adjacent two of the cylindrical electrode means so that the two cylindrical electrode means are arranged coaxially;

wherein one end portion of the cylindrical support member and one of the two cylindrical electrode means are fixed to each other by fitting the former into the latter or fitting the latter into the former;

wherein the cylindrical electrode means consists of two cylindrical members having respective flanges and the flanges are joined together.

2. An electron gun for a CRT in which a plurality of cylindrical electrodes are arranged in series to control a path of electron beams emitted from a cathode, comprising:

cylindrical electrode means adjacent to each other; and a cylindrical support member for supporting at least adjacent two of the cylindrical electrode means so that the two cylindrical electrode means are arranged coaxially;

wherein one end portion of the cylindrical support member and one of the two cylindrical electrode means are fixed to each other by fitting the former into the latter or fitting the latter into the former;

wherein the cylindrical support member is fitted into the cylindrical electrode means, and an inner wall portion of the cylindrical electrode means into which the cylindrical support member is fitted is formed with a protrusion that presses against the cylindrical support member.

3. An electron gun for a CRT in which a plurality of cylindrical electrodes are arranged in series to control a path of electron beams emitted from a cathode, comprising:

cylindrical electrode means adjacent to each other; and a cylindrical support member for supporting at least adjacent two of the cylindrical electrode means so that the two cylindrical electrode means are arranged coaxially;

wherein one end portion of the cylindrical support member and one of the two cylindrical electrode means are fixed to each other by fitting the former into the latter or fitting the latter into the former;

wherein the cylindrical electrode means is fitted into the cylindrical support member, and an outer surface portion of the cylindrical electrode means which is fitted into the cylindrical support member is formed with a protrusion that presses against the inner wall of the cylindrical support member.

4. An electron gun for a CRT in which a plurality of cylindrical electrodes are arranged in series to control a path of electron beams emitted from a cathode, comprising:

cylindrical electrode means adjacent to each other; and a cylindrical support member for supporting at least adjacent two of the cylindrical electrode means so that the two cylindrical electrode means are arranged coaxially;

wherein one end portion of the cylindrical support member and one of the two cylindrical electrode means are fixed to each other by fitting the former into the latter or fitting the latter into the former;

wherein the cylindrical support member is made of a high-resistivity conductive material and the cylindrical electrode means are grid electrodes made of a metal material.

5. An electron gun for a CRT in which a plurality of cylindrical electrodes are arranged in series to control a path of electron beams emitted from a cathode, comprising:

cylindrical electrode means adjacent to each other; and a cylindrical support member for supporting at least adjacent two of the cylindrical electrode means so that the two cylindrical electrode means are arranged coaxially;

wherein one end portion of the cylindrical support member and one of the two cylindrical electrode means are fixed to each other by fitting the former into the latter or fitting the latter into the former;

wherein the cylindrical support member comprises a cylindrical insulative member and a conductive film formed on an inner wall of the cylindrical insulative member and serving as a grid electrode.

6. An electron gun for a CRT in which a plurality of cylindrical electrodes are arranged in series to control a path of electron beams emitted from a cathode, comprising:

cylindrical electrode means adjacent to each other; and a cylindrical support member for supporting at least adjacent two of the cylindrical electrode means so that the two cylindrical electrode means are arranged coaxially;

wherein one end portion of the cylindrical support member and one of the two cylindrical electrode means are fixed to each other by fitting the former into the latter or fitting the latter into the former;

wherein the cylindrical support member comprises a cylindrical, high-resistivity conductive member and a conductive film formed on an inner wall of the cylindrical, high-resistivity conductive member and serving as a grid electrode.

* * * * *